United States Patent [19]

Balk

[11] Patent Number: 4,838,774

[45] Date of Patent: Jun. 13, 1989

[54] APPARATUS FOR MAKING A SPUN-FILAMENT FLEECE

[75] Inventor: Hermann Balk, Troisdorf, Fed. Rep. of Germany

[73] Assignee: Reifenhäuser GmbH & Co Maschinenfabrik, Troisdorf, Fed. Rep. of Germany

[21] Appl. No.: 119,398

[22] Filed: Nov. 10, 1987

[30] Foreign Application Priority Data

Jan. 21, 1987 [DE] Fed. Rep. of Germany ..... 3701531

[51] Int. Cl.[4] ..... D01D 5/12

[52] U.S. Cl. ..... 425/66; 264/176.1; 264/211.14; 264/237; 425/72.2

[58] Field of Search ..... 19/299, 300; 28/185, 28/240, 241, 273; 264/12, 103, 176.1, 177.17, 177.19, 210.8, 211.14, 211.17, 237, 518, 290.5, DIG. 73, DIG. 75; 425/66, 72.1, 72.2, 80.1, 81.1, 82.1, 140, 141, 172, 83.1, 462, 464

[56] References Cited

U.S. PATENT DOCUMENTS

| | | | |
|---|---|---|---|
| 2,881,471 | 4/1959 | Snow et al. | 425/83.1 |
| 3,684,416 | 8/1972 | Lenk | 425/72.2 |
| 3,707,593 | 12/1972 | Fukada et al. | 425/72.2 |
| 3,787,195 | 1/1974 | Kircheim | 425/81.1 |
| 3,802,817 | 4/1974 | Matsuki et al. | 425/66 |
| 3,812,553 | 5/1974 | Marshall et al. | 264/518 |
| 3,963,392 | 6/1976 | Goyal | 425/81.1 |
| 3,969,462 | 7/1976 | Stofan | 264/237 |
| 3,988,086 | 10/1976 | Marshall et al. | 425/72.2 |
| 4,017,580 | 4/1977 | Barbey | 425/66 |
| 4,025,595 | 5/1977 | Mirhej | 264/103 |
| 4,141,772 | 2/1979 | Buell | 264/518 |
| 4,217,078 | 8/1980 | Buell | 425/81.1 |
| 4,285,646 | 8/1981 | Waite | 425/72.2 |
| 4,318,676 | 3/1982 | Gerking et al. | 425/72.2 |
| 4,340,563 | 7/1982 | Appel et al. | 425/72.2 |
| 4,388,056 | 6/1983 | Lee et al. | 425/83.1 |
| 4,442,062 | 4/1984 | Fujii et al. | 264/211.14 |
| 4,553,996 | 11/1985 | Muschelknautz et al. | 425/80.1 |
| 4,612,150 | 9/1986 | De Howitt | 264/103 |
| 4,692,106 | 9/1987 | Grabowski et al. | 425/72.2 |

FOREIGN PATENT DOCUMENTS

| | | | |
|---|---|---|---|
| 2049594 | 1/1972 | Fed. Rep. of Germany . | |
| 1950435 | 4/1975 | Fed. Rep. of Germany . | |
| 3406346 | 8/1986 | Fed. Rep. of Germany . | |
| 47-50003 | 12/1972 | Japan | 425/72.2 |

*Primary Examiner*—Jay H. Woo
*Assistant Examiner*—C. Scott Bushey
*Attorney, Agent, or Firm*—Herbert Dubno

[57] ABSTRACT

The apparatus for making a spun-filament fleece from a stretched thermoplastic monofilament has a combined spinning unit made up of separate spinning units each having a plurality of spinning nozzles arranged in rows over a rectangular cross section, a blower shaft, a stretching shaft and a wire screen conveyor for the finished deposited fleece. The blower shaft is provided with air orifices for admission of stretching air simultaneously acting as a cooler. The stretching shaft has stretching shaft walls which are, if necessary, movable or adjustable with an accelerating device with a venturi nozzle like vertical cross section. At least two separate spinning units with separate groups of spinning nozzles are located above the blower shaft. At least one separating wall located between individual spinning units divides the blower shaft into separate portions for separate bands of monofilaments generated by the separate groups of spinning nozzles. The separate spinning units can be supplied with different thermoplastic materials from different extruders.

4 Claims, 3 Drawing Sheets

APPARATUS FOR MAKING A SPUN-FILAMENT FLEECE

CROSS REFERENCE TO RELATED APPLICATIONS

This application is related to the commonly owned concurrently filed copending applications Ser. Nos. 119,141; 119,197; and 119,400 now U.S. Pat. Nos. 4,820,142; 4,812,112; and 4,820,459, respectively.

FIELD OF THE INVENTION

My present invention relates to an apparatus for making a spun-filament fleece and to the manufacture of a spun-filament fleece from thermoplastic monofilament.

BACKGROUND OF THE INVENTION

An apparatus for making a spun-filament fleece from a stretched thermoplastic monofilament made of a synthetic resin material can include a spinning unit or spinneret including a plurality of spinning nozzles arranged in rows in a rectangular pattern.

The thermoplastic, issuing as a band of monofilaments into a blower shaft is exposed to a transverse blast of cooling air. The filaments are then stretched in a stretching shaft by outflowing air.

Then the stretched thermoplastic monofilaments are deposited as a fleece on a continuously moving fleece-receiving conveyor or belt beneath the stretching shaft. The conveyor may be a wire fabric belt.

The blower shaft is provided with a plurality of air orifices for admission of stretching air simultaneously serving as a cooling means. The stretching shaft has a stretching shaft wall, if necessary movable, with an accelerating device with a venturi-nozzle like vertical cross section.

In the known apparatus for making a spun-filament fleece as described in German Pat. Document No.35 03 818 the spinning nozzles form a single spinning unitor spinneret. A single band of plastic monofilaments issues from the spinning nozzles. This construction leads to certain limitations. On the one hand the throughput per spinning nozzle and thus for the entire apparatus can not be arbitrarily increased. If an attempt is made to increase throughput, a reduction in the quality of the finished fleece or nonwoven mat results. Also the fleece or nonwoven mat cannot be made from different thermoplastic materials or differently colored materials.

OBJECTS OF THE INVENTION

It is an object of my invention to provide an improved apparatus for making a spun-filament fleece which will obviate these drawbacks.

It is another object of my invention to provide an improved apparatus for making a spun-filament fleece which has a substantially higher throughput than existing apparatus without impairing the quality of the finished fleece.

It is also an object of my invention to provide an improved apparatus for making a spun-filament fleece which is made from different thermoplastic materials or different colored materials.

SUMMARY OF THE INVENTION

These objects and others which will become more readily apparent hereinafter are attained in accordance with my invention in an apparatus for making a spun-filament fleece from a stretched thermoplastic monofilament made of a thermoplastic material comprising a spinning unit including a plurality of spinning nozzles arranged in rows over a rectangular cross section, a blower shaft, a stretching shaft and a wire cloth conveyor for the spun-filament fleece. The blower shaft is provided with a plurality of air orifices for admission of stretching air simultaneously acting as a cooling means and the stretching shaft has, if necessary, movable or adjustable stretching shaft walls with an accelerating nozzle with a venturi-like vertical cross section.

According to my invention at least two parallel spinning members (i.e. spinning beams) which each have a separate spinning unit or spinneret including a separate plurality of spinning nozzles are positioned above the blower shaft and at least one separating wall extends at least over half the depth of the blower shaft and is positioned between the spinning members or spinning units.

The separating wall can be a blower wall and have a plurality of transversely blowing air orifices in both sides or both portions of the blower shaft.

Both spinning units can be connected to one and the same extruder.

It is also possible, however, in alternative embodiments of my invention to connect each spinning unit or spinning nozzle to a different extruder. Thus the fleece can be made from different plastic materials or different colored materials. It should be obvious that one can generalize the teachings of my invention both in regard to process engineering and plant technology so that one can not only process and make two different bands of thermoplastic monofilaments but also three or more.

Among the advantages attained by my invention by comparison to the earlier spun-filament mat-making apparatus is the following: a substantially higher throughput can be obtained without impairing the finished fleece quality.

Furthermore it is possible to make a fleece from different thermoplastic materials and from materials which are colored differently. It is also possible to change the physical parameters so that different flow rates or different spinning nozzles are used. It is understood that the thermoplastic stretched monofilaments are endless filaments.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
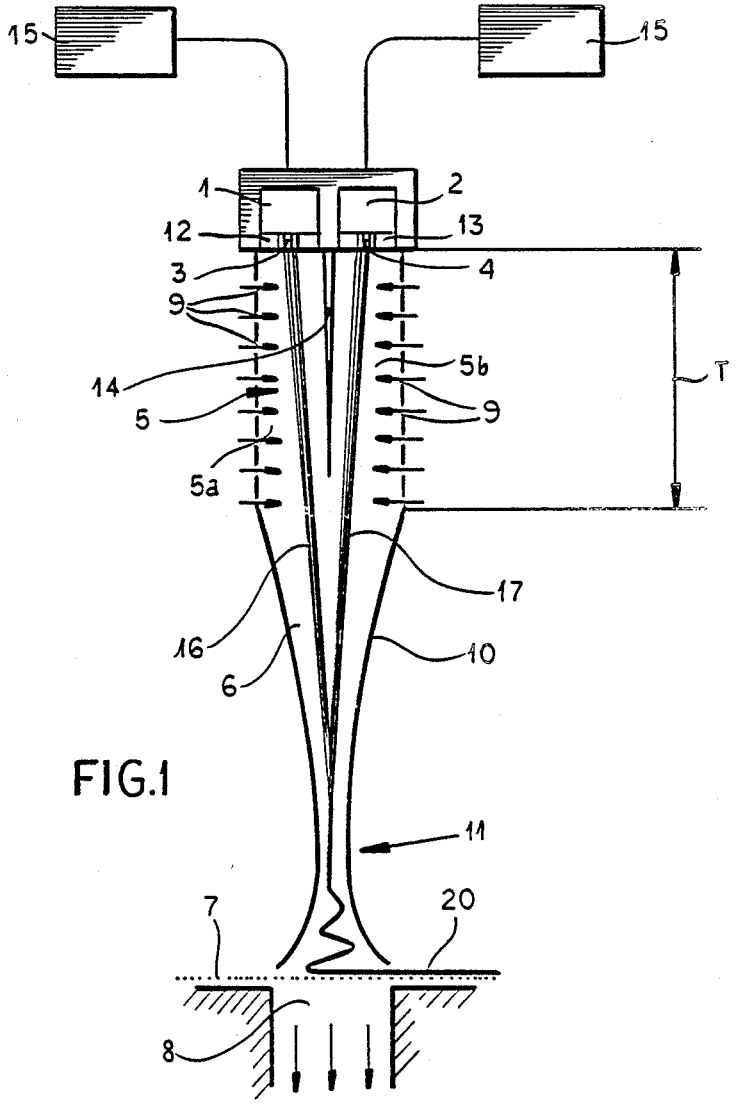
FIG. 1 is a vertical cross sectional view through an apparatus for making a spun-filament fleece according to my invention.

The apparatus shown in the drawing basically comprises a spinning unit 1, 2 including a plurality of spinning nozzles 3, 4 arranged in rows over a rectangular cross section, a blower shaft 5, a stretching shaft 6 and a wire cloth conveyor 7 for the delivered fleece with a device 8 for drawing or moving the process air.

The blower shaft 5 is provided with a plurality of air orifices 9 for admission of stretching air which simultaneously acts as a cooling medium. The stretching shaft 6 has stretching shaft walls 10 which can be movable, with an accelerating device 11 which is like a venturi nozzle in vertical cross section. The fleece-receiving conveyor 7, which is a wire cloth conveyor in this embodiment, as already mentioned, is located beneath the stretching shaft 6.

Two parallel spinning beams 12, 13 each have a respective spinneret I, 2 of the combined unit 1, 2.

Each separate spinneret 1, 2 or spinning beam 12, 13 has a separate plurality of spinning nozzles 3, 4 located above the blower shaft 5 dispensing respective curtains of thermoplastic filaments.

A separating wall 14 which in this embodiment (FIG. 1) extends over more than half the depth T of the blower shaft 5 is positioned between the spinning members 12, 13.

Figure 3:
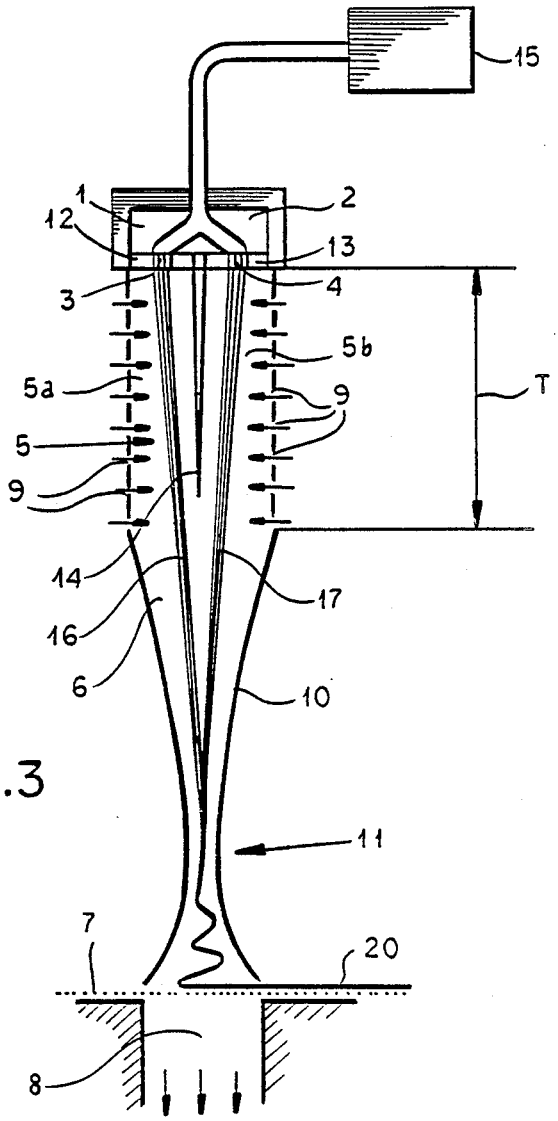
FIG. 3 is yet another vertical section through an additional embodiment of an apparatus for making a spun-filament fleece according to my invention.

In the embodiments according to FIGS. 1 and 3 the separating wall 14 is a closed separating wall without additional functions.

Figure 2:
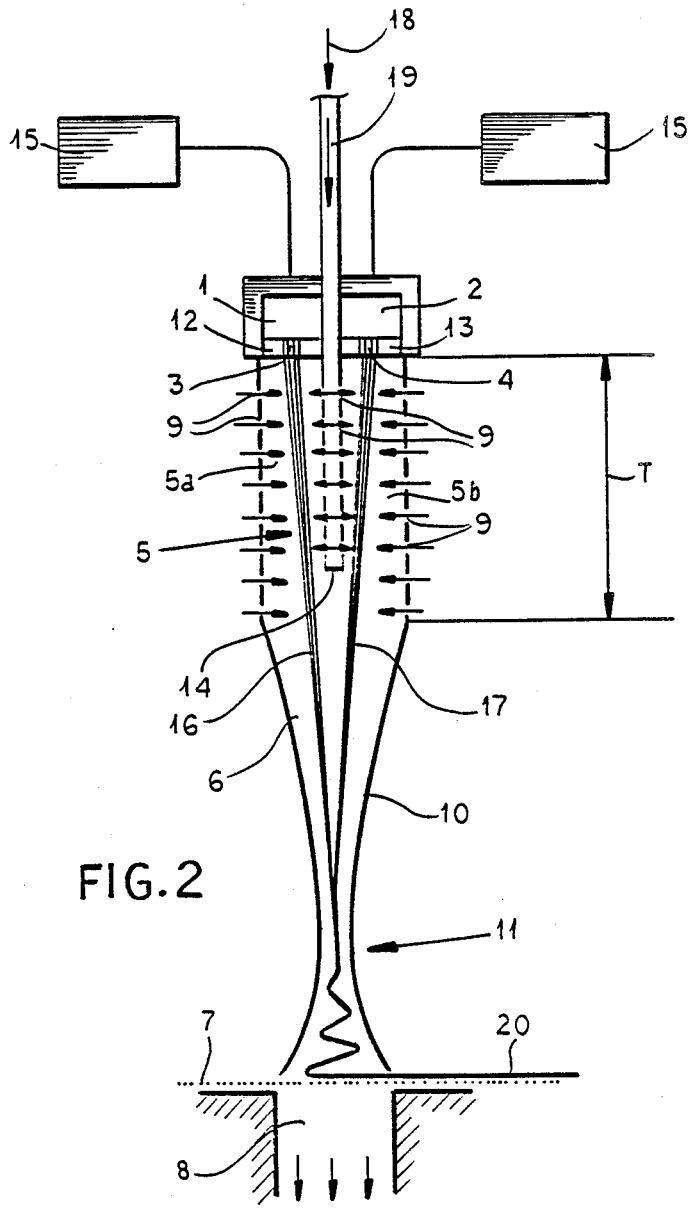
FIG. 2 is a similar view of another embodiment of an apparatus for making a spun-filament fleece according to my invention corresponding to that of FIG. 1.

In the embodiment according to FIG. 2 the separating wall 14 is a blower wall having a central air duct 19 with an air inlet 18 and provides both portions 5*a*, 5*b* of the blower shaft 5 with transversely blowing nozzle means in the form of air orifices 9 for cooling air.

In the embodiments according to FIGS. 1 and 2 the apparatus is connected to two extruders 15 so that the fleece can be made from different plastic materials or from different colored plastic material.

In the embodiment according to FIG. 3 the apparatus is connected to a single extruder 15.

In all cases the separate spinnerets 1, 2 having the separate pluralities of spinning nozzles 3, 4 can have different numbers of nozzles and also differently shaped nozzles.

In continuous operation the thermoplastic material is fed to the two separate spinnerets 1, 2 having the separate groups of spinning nozzles 3, 4 arranged in rows.

Two thermoplastic bands of monofilaments 16, 17 issuing from the separate spinnerets 1, 2 are exposed to cooling air separately in separate portions 5*a*, 5*b* of the blower shaft 5 and both plastic bands of monofilaments 16, 17 are jointly fed into a single stretching shaft 6 and are jointly deposited on the wire cloth conveyor 7 combined into a single finished spun-filament fleece or nonwoven mat 20.

I claim:

1. An apparatus for making a spun-filament fleece, comprising:

a pair of separate spinnerets each having a plurality of spinning nozzles for emitting respective curtains of continuous thermoplastic filaments downwardly;

means forming a cooling shaft below said spinnerets receiving said curtains of continuous thermoplastic filaments, said cooling shaft having walls respectively juxtaposed with outer sides of said curtains and extending therealong;

a partition in said cooling shaft extending downwardly between said curtains, separating said curtains in said cooling shaft and juxtaposed with inner sides of said curtains;

nozzle means formed on said walls for directing jets of cooling air into said shaft and inwardly along said curtains of thermoplastic filaments opposite and along said partition;

a stretching shaft below said cooling shaft and formed with stretching-shaft walls narrowing to define a venturi-line air-accelerating stretching gap and thereafter widening downwardly from said gap, whereby said curtains merge in said stretching shaft and said thermoplastic filaments are stretched;

an air-permeable receiving conveyor displaceable below said stretching shaft for receiving a fleece of said thermoplastic filaments depositing from said curtains; and an additional nozzle means formed on said partition and oriented to direct respective jets of cooling air outwardly against each of said curtains.

2. The apparatus defined in claim 1, further comprising a single extruder connected to both of said spinnerets.

3. The apparatus defined in claim 1, further comprising a respective extruder connected to each of said spinnerets.

4. An apparatus for making a spun-filament fleece, comprising:

a pair of separate spinnerets each having a plurality of spinning nozzles for emitting respective curtains of continuous thermoplastic filaments downwardly;

means forming a cooling shaft below said spinnerets receiving said curtains of continuous thermoplastic filaments, said cooling shaft having walls respectively juxtaposed with outer sides of said curtains and extending therealong;

a partition in said cooling shaft extending downwardly between said curtains, separating said curtains in said cooling shaft and juxtapose with inner sides of said curtains;

nozzle means formed on said walls for directing jets of cooling air into said shaft and inwardly against said curtains of thermoplastic filaments opposite and along said partition;

a stretching shaft below said cooling shaft and formed with stretching-shaft walls narrowing to define a venturi-like air-accelerating stretching gap and thereafter widening downwardly from said gap, whereby said curtains merge in said stretching shaft to stretch said thermoplastic filaments, said stretching-shaft walls being movable relative to one another to adjust a width of said gap;

an air-permeable receiving conveyor displaceable below said stretching shaft for receiving a fleece of said thermoplastic filaments depositing from said curtains; and an additional nozzle means formed on said partition and oriented to direct respective jets of cooling air outwardly against each of said curtains.

* * * * *